US008191174B2

(12) United States Patent
Winningham et al.

(10) Patent No.: US 8,191,174 B2
(45) Date of Patent: Jun. 5, 2012

(54) PROTECTIVE GLOVE ELEMENTS WITH FLEXIBLE MATERIALS IN THE JOINTS

(75) Inventors: Matthew M. Winningham, Royal Oak, MI (US); Joseph G. Gabry, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 417 days.

(21) Appl. No.: 12/463,771

(22) Filed: May 11, 2009

(65) Prior Publication Data

US 2009/0222967 A1 Sep. 10, 2009

Related U.S. Application Data

(63) Continuation-in-part of application No. 12/211,178, filed on Sep. 16, 2008, now Pat. No. 8,108,951, which is a continuation-in-part of application No. 12/211,181, filed on Sep. 16, 2008.

(60) Provisional application No. 61/052,666, filed on May 13, 2008, provisional application No. 60/973,838, filed on Sep. 20, 2007, provisional application No. 60/984,590, filed on Nov. 1, 2007, provisional application No. 60/973,838, filed on Sep. 20, 2007, provisional application No. 60/984,590, filed on Nov. 1, 2007.

(51) Int. Cl.
*A41D 19/00* (2006.01)

(52) U.S. Cl. ..... 2/161.1; 2/163

(58) Field of Classification Search ..... 2/16, 455, 2/24, 267, 22, 465, 456, 459, 460, 461, 463, 2/20, 21, 163, 161.6, 161.1; 602/62, 63, 602/4, 5, 26, 21, 23, 60, 61, 64, 27, 28, 29, 602/20, 22
See application file for complete search history.

(56) References Cited

U.S. PATENT DOCUMENTS 381,687 A 4/1888 Fischer
(Continued)

FOREIGN PATENT DOCUMENTS

DE 2842720 4/1980
(Continued)

OTHER PUBLICATIONS

STX Lacrosse Catalog 2000: Prototype Athletic Equipment.

*Primary Examiner* — Shaun R Hurley
*Assistant Examiner* — Khaled Annis
(74) *Attorney, Agent, or Firm* — Warner Norcross & Judd LLP

(57) ABSTRACT

A conformable shielding for protective equipment including multiple shielding elements constructed from rigid, impact resistant material and a flexible material overlaying the elements. The material can include a connecting element joining the shielding elements. The connecting element can enable adjacent shielding elements to flex about a plurality of axes, relative to one another, and to extend outwardly from one another, and to retract toward one another. The connecting element can include an accordion structure positioned between adjacent shielding elements, and can be aligned with a joint of the appendage of the wearer.

13 Claims, 3 Drawing Sheets

U.S. PATENT DOCUMENTS 1,277,706 A 9/1918 Dorfman
1,951,190 A * 3/1934 Gambee ..... 2/21
2,293,347 A 2/1940 Lindfield
2,708,753 A 3/1952 Kennedy
2,639,950 A 5/1953 Wheeler
2,831,196 A 9/1955 Scheiber
3,037,209 A 6/1962 Applegate, Jr. et al.
3,387,306 A 6/1968 Korey
3,882,548 A 5/1975 Shinagawa et al.
4,094,014 A 6/1978 Schroeder
D257,909 S 1/1981 Brine
4,272,849 A 6/1981 Thurston et al.
4,355,424 A 10/1982 McCoy, Jr.
4,411,024 A 10/1983 Hayes
4,422,183 A 12/1983 Landi et al.
4,441,211 A 4/1984 Donzis
4,453,271 A 6/1984 Donzis
4,467,475 A 8/1984 Gregory et al.
4,484,359 A 11/1984 Tirinen
4,497,073 A 2/1985 Deutsch
4,513,449 A 4/1985 Donzis
4,519,097 A 5/1985 Chappel, Jr. et al.
4,570,269 A 2/1986 Berlese
4,590,622 A 5/1986 Wolfe et al.
4,662,006 A 5/1987 Ross, Jr.
4,677,698 A 7/1987 Angas
4,815,147 A 3/1989 Gazzano et al.
4,894,866 A 1/1990 Walker
4,894,868 A 1/1990 Christopher
4,930,162 A * 6/1990 Cote ..... 2/20
4,947,486 A 8/1990 Hsuih
4,951,689 A * 8/1990 Jones ..... 2/161.1
4,984,300 A 1/1991 Cho
4,985,931 A 1/1991 Wingo, Jr.
5,147,285 A * 9/1992 Buxton ..... 602/22
5,159,715 A 11/1992 Jurga et al.
5,168,576 A 12/1992 Krent et al.
5,173,964 A 12/1992 Ball et al.
5,237,703 A 8/1993 Brine et al.
5,329,639 A 7/1994 Aoki
5,345,609 A 9/1994 Fabry et al.
5,390,372 A 2/1995 Hashimoto et al.
5,459,883 A 10/1995 Garceau-Verbeck
5,472,769 A 12/1995 Goerz, Jr. et al.
5,488,739 A 2/1996 Cardinal
5,511,243 A 4/1996 Hall et al.
5,530,966 A 7/1996 West
5,548,844 A 8/1996 Ceresia
5,623,728 A 4/1997 Wagner
5,652,967 A 8/1997 Hsu
5,745,916 A 5/1998 Linner
5,781,929 A 7/1998 Shikatani
5,787,506 A 8/1998 Wilder et al.
5,946,720 A 9/1999 Sauriol
5,974,588 A 11/1999 Furman
5,983,396 A 11/1999 Morrow et al.
6,035,453 A 3/2000 Cain
6,085,354 A 7/2000 Wilder et al.
6,098,196 A 8/2000 Logan
6,122,769 A 9/2000 Wilder et al.
6,154,882 A 12/2000 Ullmann
6,182,288 B1 2/2001 Kibbee
6,209,137 B1 4/2001 Wallick
6,233,744 B1 5/2001 McDuff
6,240,565 B1 6/2001 Spear
6,247,188 B1 6/2001 Beland
D446,888 S 8/2001 Morrow
6,295,654 B1 10/2001 Farrell
6,389,601 B2 5/2002 Kleinert
6,405,380 B1 6/2002 Kuroda et al.
6,425,134 B1 * 7/2002 Huang ..... 2/20
D462,146 S 8/2002 Aoki
6,453,474 B2 9/2002 Kleinert
6,526,592 B1 3/2003 Best
6,543,057 B2 4/2003 Beland et al.
6,550,069 B1 4/2003 Morrow
6,625,815 B2 9/2003 Litke
6,643,844 B2 11/2003 Morrow et al.
6,681,402 B1 1/2004 Bevier et al.
6,684,406 B2 * 2/2004 Fowler ..... 2/16
6,701,530 B2 3/2004 Kleinert
6,799,333 B2 10/2004 Morrow et al.
6,813,780 B2 11/2004 Morrow
6,813,781 B2 * 11/2004 Wilder et al. ..... 2/161.1
6,839,910 B2 1/2005 Morrow et al.
6,959,453 B2 11/2005 Best
7,000,256 B2 2/2006 Kleinert
7,114,193 B2 10/2006 Winningham
7,117,540 B2 * 10/2006 Morrow ..... 2/161.1
7,275,268 B2 10/2007 Gait
7,318,241 B2 1/2008 Morrow
7,356,849 B2 4/2008 Morrow et al.
7,370,373 B2 5/2008 Kohler
7,487,556 B2 2/2009 Morrow et al.
7,836,521 B2 11/2010 Winningham
7,841,023 B2 11/2010 Winningham
7,861,321 B2 1/2011 Winningham
2002/0069445 A1 * 6/2002 Beland et al. ..... 2/16
2004/0261155 A1 12/2004 Agathos et al.
2006/0010552 A1 * 1/2006 Gait ..... 2/16
2008/0178359 A1 7/2008 Grilliot et al.
2008/0244799 A1 10/2008 Winningham
2009/0222967 A1 9/2009 Winningham et al.

FOREIGN PATENT DOCUMENTS

DE 2843448 4/1980
DE 3135756 4/1983
WO 03013292 2/2003
WO 2007103985 9/2007

* cited by examiner

PROTECTIVE GLOVE ELEMENTS WITH FLEXIBLE MATERIALS IN THE JOINTS

CROSS-REFERENCE TO RELATED APPLICATIONS

This application claims benefit of U.S. Provisional Application No. 61/052,666, filed May 13, 2008, which is hereby incorporated by reference. This application also is a continuation-in-part of U.S. application Ser. No. 12/211,178, filed Sep. 16, 2008, which claims benefit of U.S. Provisional Application No. 60/973,838, filed Sep. 20, 2007, and U.S. Provisional Application No. 60/984,590, filed Nov. 1, 2007, all of which are incorporated by reference herein. This application also is a continuation-in-part of U.S. application Ser. No. 12/211,181, filed Sep. 16, 2008, which claims benefit of U.S. Provisional Application No. 60/973,838, filed Sep. 20, 2007, and U.S. Provisional Application No. 60/984,590, filed Nov. 1, 2007, all of which are incorporated by reference herein.

BACKGROUND OF THE INVENTION

The present invention relates to protective equipment, and more particularly, to protective equipment having shielding components moveable relative to one another.

In contact and high impact sports, such as hockey, lacrosse, football, and motocross, participants are routinely subject to high impact forces generated by body blows, checks, falls, and/or hits with sticks or helmets. The participant's fingers, hands, elbows, knees and shoulders are especially vulnerable to injury when being forcibly impacted. Accordingly, participants typically wear padded equipment, such as gloves, elbow pads, knee pads and shoulder pads to protect the respective parts of their body.

Even while wearing the protective equipment, certain areas of a player's body can be susceptible to injury. Those areas usually correspond to locations where the protective equipment bends to enable flexing of an underlying joint, such as the wrist, knuckles, elbows, knees or shoulders. During such bending, the joint can be exposed if the protective equipment retracts from the underlying joint, leaving the joint susceptible to injury during flexion by impact forces.

Certain protective equipment includes individual segments of protective plates connected to one another at fixed, pivot joints to allow relative pivotal movement between the adjacent segments along a fixed, single axis of rotation. Although conventional pivot joints generally allow movement of the user's underlying joint, they also artificially constrain that movement because human joints do not generally pivot about a single, fixed axis of rotation.

Another issue with fixed pivot points corresponding to joints in protective equipment is that such constructions can be complicated and relatively costly. For example, pivoting parts of equipment attached at pivot points usually require pins or rivets installed through aligned holes in the pivoting parts. An example of this is illustrated in U.S. Pat. No. 381,687, which shows a baseball glove including multiple finger plates pivotally joined at pivot points with pins. The component and assembly costs of such pivoting constructions can be prohibitive.

SUMMARY OF THE INVENTION

Protective equipment can be provided with shielding elements including multiple relatively rigid, impact resistant segments joined with one another by a flexible material, such as an elastomeric material. The material can enable the joined shielding elements to move, flex, twist, extend and/or retract relative to one another on or along fixed, non-fixed, single, multiple or compound axes.

In one embodiment, the material can include a connecting element extending between adjacent shielding elements. The connecting element can enable those shielding elements to flex about one or more axes, relative to one another, and to extend away from one another, and to retract toward one another. Optionally, the connecting element can be aligned with a joint of an appendage of the wearer of the protective equipment.

In another embodiment, portions of the joined shielding elements can overlap one another through the natural range of movement of the underlying joint. As such, the underlying joint can be protected against impact forces along the length of the joined shielding elements.

In yet another embodiment, a method of manufacturing conformable shielding for protective equipment is provided. The method can include providing one or more relatively rigid, hard, impact resistant shielding elements, and disposing the elements in a predetermined location within a mold cavity. The individual elements can be joined with one another by overmolding a material at least partially over the elements to form a unitary shielding structure. The structure can be removed from the mold cavity and joined with a selected portion of protective equipment.

In a further embodiment, the method of manufacture can include forming one or more openings in selected areas of the shielding elements before molding. The material can be molded at least partially over the shielding elements and at least partially within the openings to mechanically interlock the material to the shielding elements.

In yet a further embodiment, the flexible shielding can be incorporated into protective gloves, elbow pads, knee pads or shoulder pads, as used in various sports, such as hockey, lacrosse, football, motocross or other contact sports or activities where forceful blows or falls are common.

The embodiments described herein provide a simple and efficient protective shielding system for use with protective equipment such as protective sports equipment. Where the shielding elements are joined with material that allows them to move relative to one another on varying axes, a user's underlying joint(s) both can be protected by the shielding and can maintain an uninhibited, full range of natural movement of the user's joint and related appendage, such as a finger, wrist, knee, shoulder, elbow, hip, neck or the like. Where the shielding elements are joined with interconnecting elastomeric material, the resulting protection afforded can be generally uninterrupted along the length of the appendage protected, while the weight of the protective element is significantly reduced.

These and other objects, advantages, and features of the invention will be more fully understood and appreciated by reference to the description of the current embodiment and the drawings.

DESCRIPTION OF THE CURRENT EMBODIMENT

I. Overview

Figure 1:
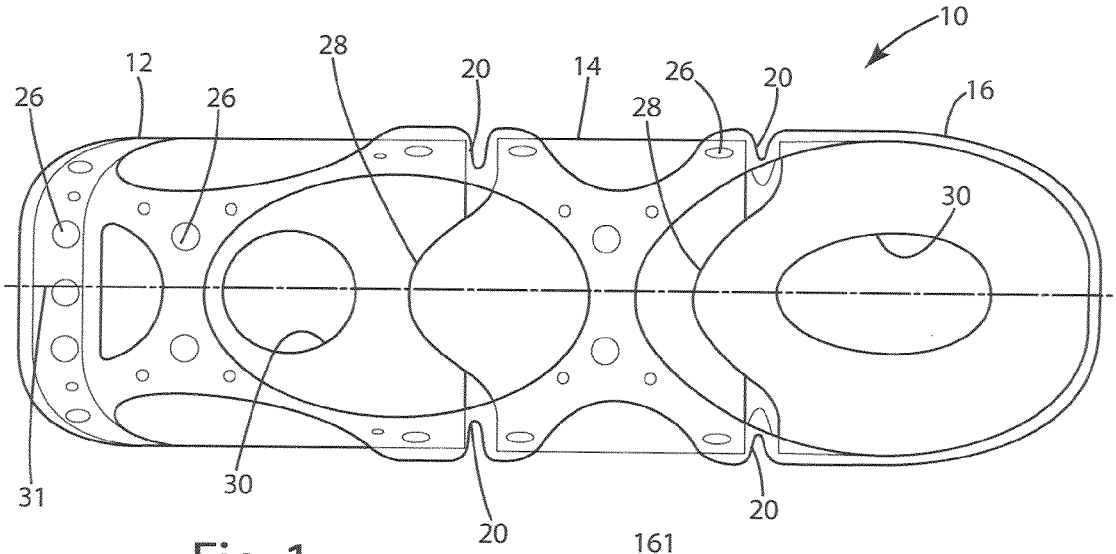
FIG. 1 is a top view of conformable shielding according to a current embodiment in an extended position.
Figure 2:
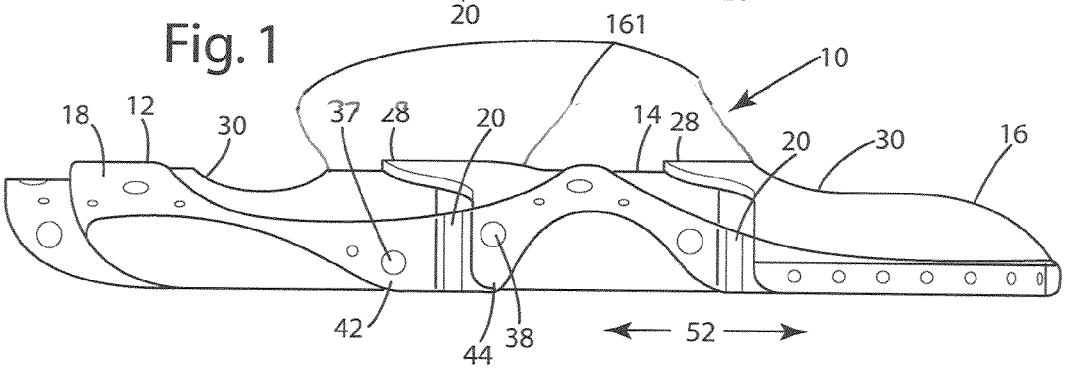
FIG. 2 is a side view of the shielding in an extended position.

A current embodiment of the conformable shielding is illustrated in FIGS. 1-8 and generally designated 10. The conformable shielding 10 can be incorporated in various types of protective equipment, including: protective gloves, elbow pads, knee pads, or shoulder pads, such as those used in various sports like hockey, lacrosse, football, motocross, or any other activity, such as law enforcement or military operations where impact, falls or blows may be encountered. As described herein, the shielding is included in a protective glove for use in sporting activities, such as lacrosse or hockey.

The shielding 10 generally includes multiple relatively rigid, hard, impact resistant segments or shielding elements 12, 14, 16 joined with one another by a material 18. Although only three elements are shown, more or fewer (a pair) of elements can be joined with one another, depending on the type of equipment being constructed. The material 18, in addition to forming connecting elements 20 to connect the individual shielding elements 12, 14, 16 to one another, can enable the joined elements 12, 14, 16 to move or flex, twist, extend and retract relative to one another along non-fixed, single, multiple or compound axes. Accordingly, a user's joint under shielding 10 maintains an uninhibited, full range of natural motion, while still receiving the full benefit of being protected.

II. Construction

The individual shielding elements 12, 14, 16 can be constructed from any suitable material, optionally rigid, impact resistant materials, that is, materials that retain their shape without substantial external support and are adapted to withstand instant or rapid loading caused by impacts without fracturing. Suitable materials which are hard and/or rigid, and impact resistant, include, but are not limited to, polypropylene (PP), polycarbonate (PC), actrylonitrile butadiene styrene (ABS), PC/ABS compounds, styrene and/or high impact styrene (HIPS), nylon 6 and/or 6,6 (PA6, PA66), polyethylene (PE), copolyester, propionate, and acetal (POM). Other suitable materials include metals, such as stainless steel or aluminum alloys, composites, and laminates of varying materials which are generally hard and impact resistant.

The shielding elements 12, 14, 16 can be constructed having any suitable size and shape, depending on the age and size of the wearer and the type of sporting equipment being constructed. Optionally, one or more of the shielding elements can include a curved or contoured cross section to conform to an appendage of a wearer of the protective sporting equipment. Indeed, the shielding elements can be form-fitted to a particular wearer's appendage or other body structure as desired.

Figure 4:
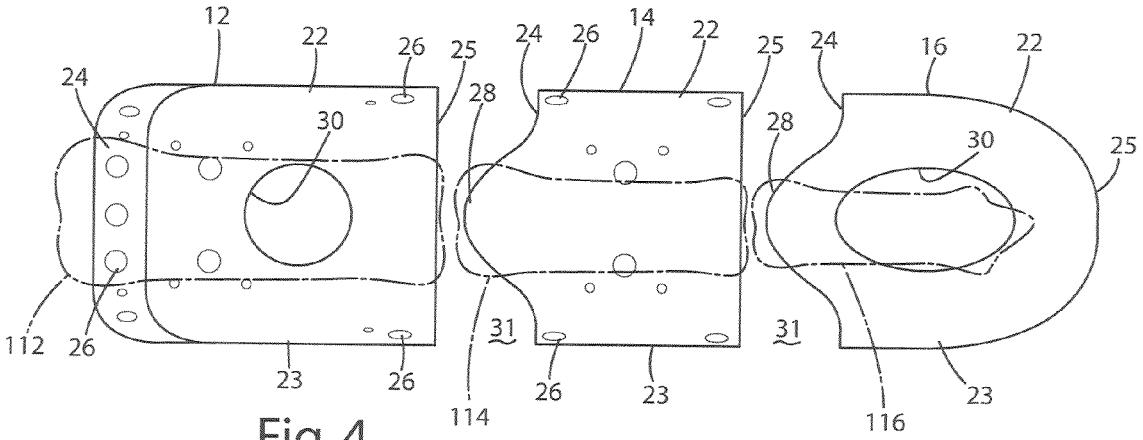
FIG. 4 is a top view of shielding elements shown before the elements are joined with a material.

As best shown in FIG. 4, each of the shielding elements 12, 14, 16 have opposite sides 22, 23 establishing a width extending between opposite first and second ends 24, 25 establishing a length. The opposite sides can transition to an upper portion 161 of the shielding element. Between ends 24, 25 of adjacent shielding elements, a gap 31 can be defined. Generally, the gap 31 can be defined by the shape and configuration of the borders of the ends 24, 25 adjacent it. The gap can be of varying dimension, but generally separates the adjacent shielding elements by about 1 mm to about 50 mm, optionally about 5 mm to about 20 mm, or any other distance as desired. The gap can further be aligned with and correspond to an underlying joint of a wearer of the shielding. Optionally, the shielding elements can also include an interior surface 21 adapted to face an appendage of the wearer, and an exterior surface 29 opposite the interior surface.

In the embodiment illustrated, the shielding elements can be configured to protect joints of an appendage, for example, a digit, of a wearer of protective equipment including the shielding 10. Optionally, the first shielding element 16 can be adapted to overlay and protect a distal phalanx 116 of a wearer's digit, the second shielding element 14 can be adapted to overlay and protect a middle phalanx 114 of a wearer's digit, and a third shielding element 12 can be adapted to overlay and protect a proximal phalanx 112 of a wearer's digit.

Figure 7:
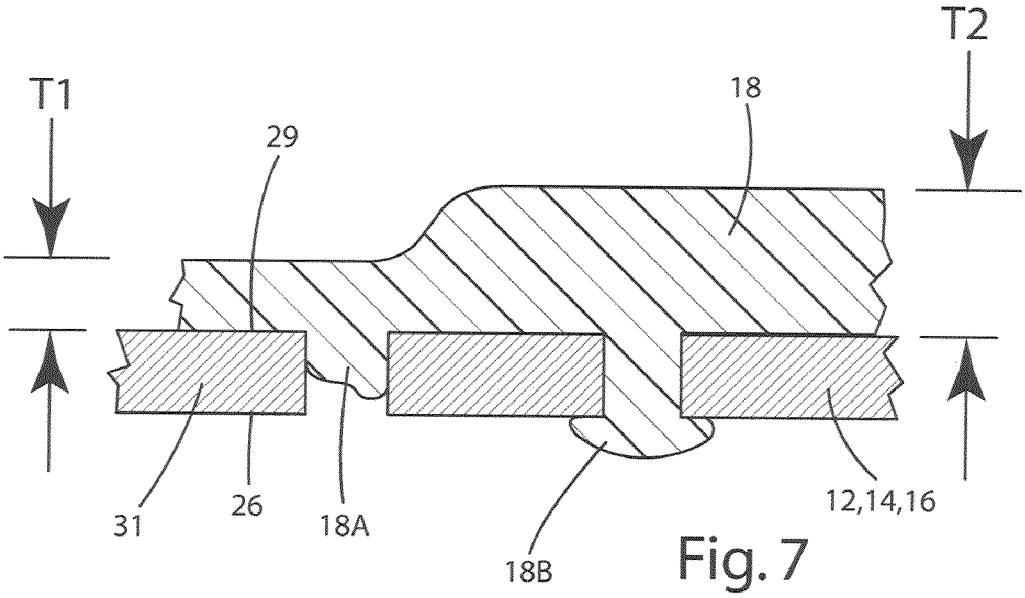
FIG. 7 is a close-up sectional view of a material joined with a shielding element.

The shielding elements can be joined with one another via a material 18, which optionally can be flexible and elastomeric. Examples of suitable materials can be any flexible material(s), such as elastomers, optionally a thermoplastic elastomer (TPE), natural rubber, butyl rubber, synthetic polyisoprene, polybutadiene, nitrile rubber, neoprene, silicone rubber, silicone, polyether block amides, ethylene-vinyl acetate, thermoplastic polyurethane, thermoplastic olefins, or other elastomers as desired. The material 18, as shown in FIG. 7, can be of varying thicknesses T1 and T2 depending on where it is located relative to the shielding elements. For example, where the material is near an end 24 or 25, or in an area adjacent a gap and a connecting element 20, the material can be of a greater thickness T2, which can vary from about 1 mm to about 10 mm, optionally about 3 mm to about 8 mm, or other thicknesses as desired. Optionally, this added thickness sometimes can withstand the stretching and flexing of the connecting element 20. In areas where insignificant stress or force is exerted on the material, for example, on the upper portions of the shielding elements, the thickness T1 can be less than thickness T1. The thickness T1 can vary from about 1 mm to about 5 mm, optionally about 2 mm to about 4 mm. Of course, thicknesses T1 and T2 can vary depending on the application.

The shielding elements can also define a plurality of apertures 26 to enable the elastomeric material 18 to mechanically interlock the material to the respective shielding elements. This mechanical interlock can provide an enhanced physical attachment of the material 18 to the segments 12, 14, 16. As used herein, the term aperture can refer to an opening that extends partially or entirely through the shielding element, a recess, a slot, a hole, a surface aberration that creates raised ribs or bumps, and/or the like. As desired, instead of apertures, the surface of the shielding can include minute hairs created by sanding the shielding surface, or other surface projections that increase the surface area and enhance connection of the material to the shielding.

Referring to FIG. 7, the material 18 can mechanically interlock with the applicable shielding element 12, 14, 16 in a variety of manners. For example, the material 18 can overlay an exterior 29 of the shielding element, and can project partially into the apertures as shown at 18*a*. Optionally, the material 18 can overlay the exterior 29, project entirely through the aperture 26, and form a flange or portion 18*b* that extends beyond the boundary of the aperture 26. Of course, the material can project into the aperture 26 any depth as desired. Further optionally, the material 18 can be joined with the respective shielding elements 12, 14, 16 without extending substantially beyond the elements. For example, where the shielding elements are joined with a glove finger portion 162 (FIG. 8), the material 18 need not extend onto or over the finger portion 162. As a further example, the material 18 optionally does not circumferentiate a wearer's appendage.

As shown in FIG. 4, the shielding element 12 is represented as a proximal portion of a finger or thumb segment for protecting an area near the knuckles of a hand, with the shielding element 14 being a mid-portion, and the shielding element 16 being a distal portion for protecting the tips of the fingers or thumbs. The apertures 26 of the proximal segment 12 are shown as being located generally adjacent the sides 22, 23 and along the end 24. These additional apertures can provide additional points of attachment and further mechanical interlock in the region of the knuckles where the shielding element might encounter increased abrasion and impacts due to contact of the knuckles with other objects.

The apertures 26 of the mid-shielding element 14 can be defined adjacent the sides 22, 23, and the apertures of the distal segment 16 can be positioned along the sides 22, 23 and about the tip or end 25. Again, an increased number and concentration of apertures can be located at the tip 25 along the lower rim thereof so as to enhance the mechanical interlock of the material to the shielding element 16 in areas of increased abrasion and impact with other objects to prevent it from separating from the shielding element.

Figure 5:
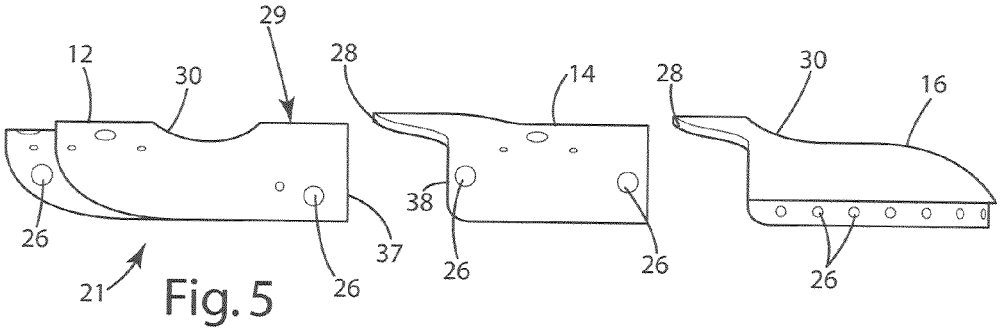
FIG. 5 is a side view of the shielding elements.
Figure 6:
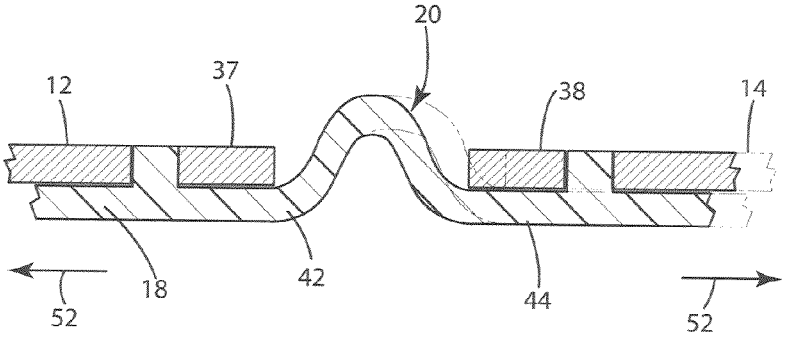
FIG. 6 is a view of an elastomeric connecting element adjacent shielding elements.

The apertures 26 can also be configured in pairs near the ends 24, 25 of adjacent shielding elements. For example, as shown in FIGS. 5 and 6, the apertures can include one or more connecting element aperture pairs including a first aperture 37 defined by a first shielding element 12 and a second aperture 38 defined by a second shielding element 14 adjacent the first shielding element. The first and second apertures can be distanced from one another so that they do not overlay one another, and in general, are not aligned.

As explained in further detail below, the connecting element 20 can include a first end 42 and a second end 44. The first end 42 can include a portion that extends into the first aperture 37, and the second end 44 can include another portion that extends into the second aperture 38. Of course, different apertures of different sizes can be formed in other areas, depending on where the elastomeric material 18 is joined with the respective shielding elements 12, 14, 16, and/or the relative degree of mechanical interlocking desired.

Figure 3:
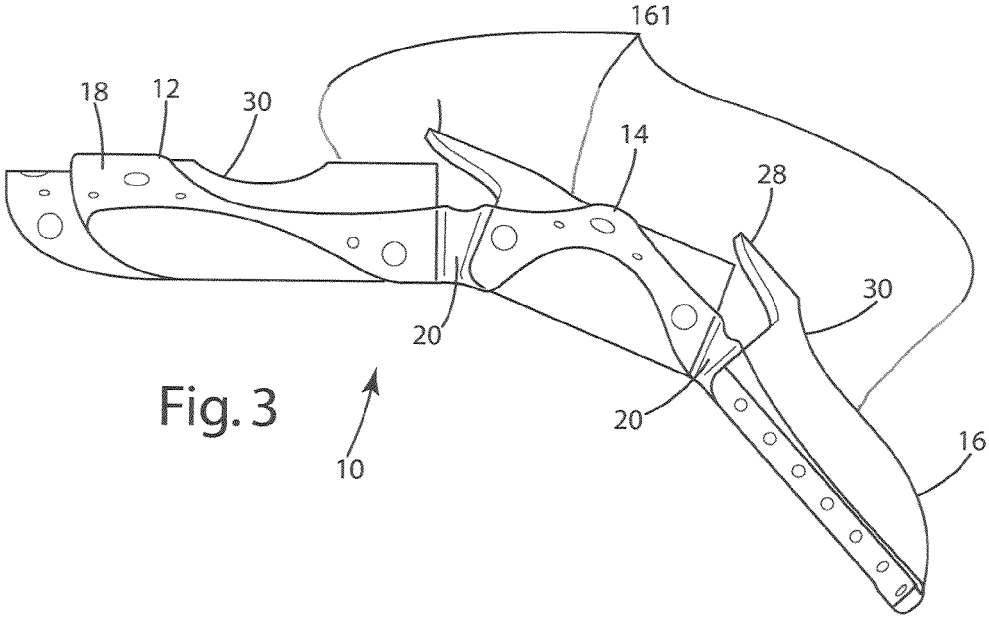
FIG. 3 is a side view of the shielding in a flexed position.

To maintain protective coverage of the underlying joint at least one of the shielding elements 12, 14, 16 can include projections 28 extending lengthwise from an the ends 24 of the respective shielding elements. The projections 28 as shown can be arcuate and extend outwardly from the ends 24 generally between the sides 22, 23. As shown in FIG. 3, the projections 28 protrude outward over the gaps 31 so that each gap remains at least partially, if not entirely, covered by the projection when the appendage of the wearer is in a flexed state. More generally, the projections 28 can be configured to overlap the adjacent ends 25 of the respective shielding elements 12, 14. And again as shown in FIGS. 3-4, the projections 28 optionally can extend lengthwise sufficiently to overlap the adjacent shielding elements 12, 14 even when the shielding 10 is in a fully flexed state (FIG. 3).

Between the respective ends 24, 25 of adjacent shielding elements, the material 18 can include the connecting elements 20 extending between adjacent ones of the shielding elements to join those shielding elements to one another. The connecting elements 20 can be formed along the sides 22, 23 of the shielding elements and can optionally terminate short of the upper portion of the shielding element so that the gap 31 there is generally uncovered by the connecting elements. Alternatively, the connecting elements can extend from one side 22 to the other 23, but can be of decreased thickness across the upper portion of the shielding element so as not to substantially impair the flexion of the underlying joint.

The connecting elements 20 can be formed to enable the shielding elements 12, 14, 16 to bend or flex relative to one another along axes corresponding to the axes of movement of the underlying joint. As an example of structure that can further enable this natural flexing, bending and/or twisting movement, the connecting elements can include an undulating, zig-zag, multi-ridged, or multi-valleyed structure, all referred to as an accordion structure, which is shown in FIG. 6. With the optional accordion or comparable structure, the connecting elements 20 can elongate and/or extend, during flexing or bending of the joint, and contract to follow the true motion of the joint as shown by arrows 52 in FIGS. 3 and 6. Optionally, this extension and retraction can be accomplished by varying the thickness or cross section or amount of material of the connecting element rather than including the accordion structure.

Accordingly, the connecting elements 20 can provide more than just a "pivoting" motion about a fixed single axis for the underlying joint with which the connecting element is generally aligned. For example, the connecting elements can enable the segments 12, 14, 16 to extend axially away from one another, thereby allowing the overall length established between the end 24 of segment 12 and the end 25 of segment 16 to increase, while also allowing the shielding elements 12, 14, 16 to twist slightly relative to one another about an axis 31 extending along their length (FIG. 1).

Figure 8:
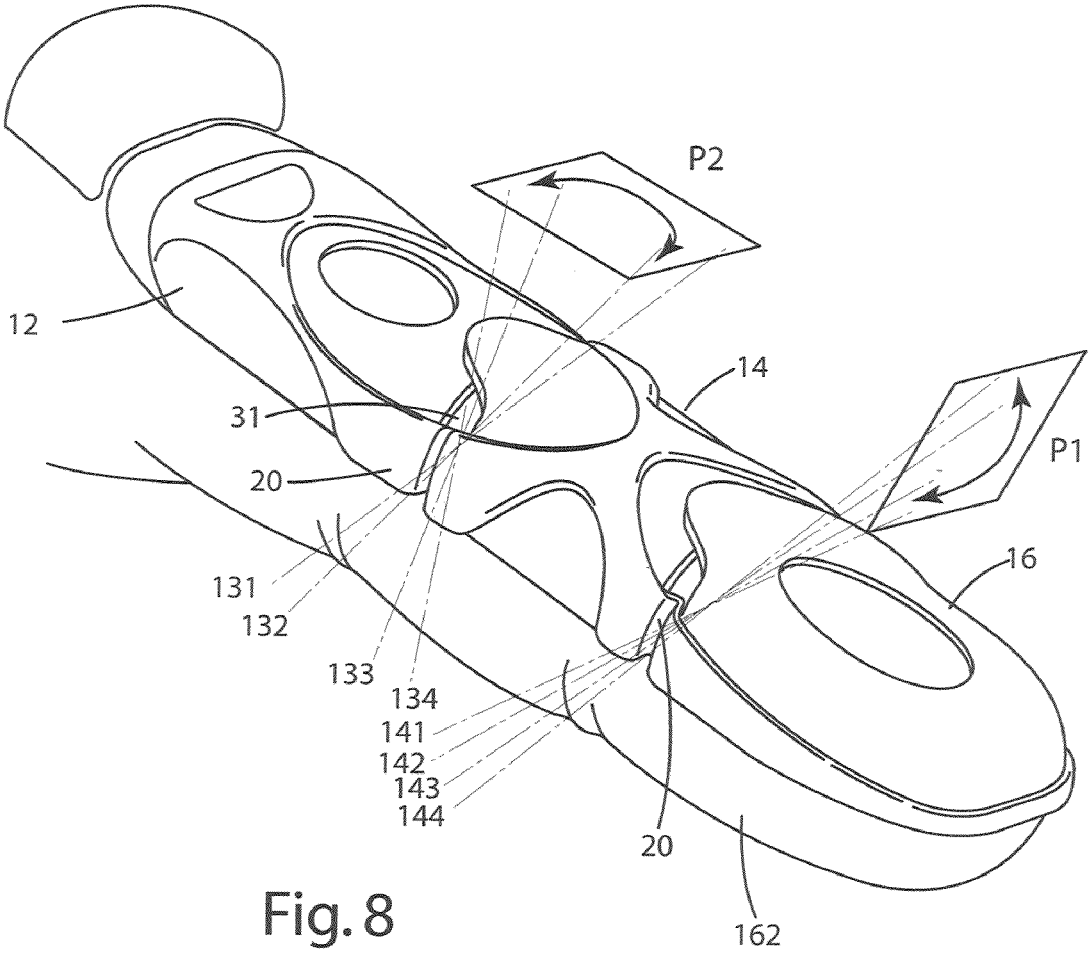
FIG. 8 is a perspective view of the conformable shielding articulating about multiple compound axes.

The connecting elements 20 can also enable the shielding elements to flex or articulate about a single or multiple axes, relative to one another. For example, as shown in FIG. 8, the connecting elements 20 can enable flexing of shielding element 14 relative to shielding element 12 about an infinite number of axes, such as axes 131, 132, 133, 134 in horizontal plane P1. Likewise, connecting elements 20 can enable flexing of shielding element 16 relative to shielding element 14 about an infinite number of axes, such as, 141, 142, 143, 144 in vertical plane P2. Of course, the shielding elements 12,14 and 16 can flex relative to one another about axes similar to any of the aforementioned axes due to the flexible nature of the connecting element. Moreover, the axes shown are only illustrative.

The connecting elements can flex and move about other axes in virtually any other plane between the horizontal and vertical planes P1 and P2 shown. Optionally, the connecting elements can also flex and move about axes above and below, or forward and rearward of the planes P2 and P1. Indeed, the compound axes of the connecting elements about which the shielding elements can rotate, move or otherwise flex can optionally be infinite. Due to their optional immense number of movement axes, the connecting elements can be virtually void of permanently defined, single pivot points, which are prevalent in conventional shielding.

In addition to the apertures 26 that can mechanically interlock the material 18 to the shielding elements, the shielding elements 12, 14, and/or 16 can define vent openings 30 formed in predetermined locations. The vent openings 30 can allow air-flow through the respective segments, shown here as segments 12 and 16. This can reduce heat retention by the shielding 10 and thus, reduce perspiration originating in the underlying appendage of the wearer.

III. Method of Manufacture

The material 18 can be joined with the shielding elements using a variety of techniques. In one embodiment, the material 18 can be molded to the elements 12, 14, 16, such as in an overmolding process, using injection molding or optionally pour molding. Other molding processes can be used as desired. In the molding process, the shielding elements 12, 14, 16 can be provided as separate individual elements and positioned in predetermined positions within a mold cavity. When in their predetermined positions, the projections 28 (if included) can be in their overlapping relation, as discussed above. The material 18 can be injected in an overmolding process, sometimes referred to as "in-mold assembly," into the mold cavity about the desired areas of the individual shielding elements 12, 14, 16, and in desired amounts and thicknesses, depending on the mold cavity and element positioning. Where included, the material 18 can flow at least partially into the openings 26.

During molding, the material can form the desired connecting elements 20, which extend between adjacent shielding elements to join those shielding elements. The resulting joined material 18 and shielding elements 12, 14 and 16 can form a unitary shielding structure, for example, the shielding 10. The unitary shielding structure can then be removed from the mold, trimmed, polished or subjected to further operations. The shielding 10 can them be joined with a portion of protective equipment so that the connecting element is aligned with a portion of the protective equipment that is adapted to flex with the joint of a wearer of the protective equipment.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A conformable shielding for protective equipment, comprising:

a plurality of shielding elements constructed from a rigid, impact resistant material, at least one of the shielding elements having a curved cross section to conform to an appendage of a wearer of the protective equipment, at least one of the shielding elements defining a plurality of apertures, the plurality of shielding elements including an interior surface adapted to face the appendage of the wearer, and an exterior surface opposite the interior surface;

a flexible elastomeric material joined with adjacent ones of the shielding elements, the flexible elastomeric material overlaying at least a portion of the exterior surface, the flexible elastomeric material at least partially projecting into the plurality of apertures defined by the shielding elements to provide a mechanical interlock between the flexible elastomeric material and the respective shielding elements, the elastomeric material including a connecting element extending between adjacent ones of the shielding elements to join the adjacent shielding elements, wherein the connecting element enables the adjacent ones of the shielding elements to flex about a plurality of axes, relative to one another, and to extend outwardly from one another, and to retract toward one another, wherein the connecting element is aligned with a joint of the appendage of the wearer, wherein the connecting element includes an accordion structure positioned between spaced apart side portions of the adjacent shielding elements, the accordion structure providing flexibility to the connecting element, wherein each shielding element includes a first end and a second end, wherein the first end of the at least one shielding element is adjacent the second end of another shielding element with a ventilation gap defined therebetween, wherein at least a portion of the joint of the wearer's appendage is located under the ventilation gap, the flexible elastomeric material leaving at least a portion of the ventilation gap uncovered when the appendage is in a flexed state and in an unflexed state, wherein the first end of the shielding element includes a projection that protrudes outward over the ventilation gap so that the ventilation gap remains at least partially covered by the projection when the appendage of the wearer is in the flexed state.

2. The conformable shielding of claim 1 wherein the appendage is a digit of a wearer's hand, wherein the plurality of shielding elements include a first shielding element adapted to overlay and protect a distal phalanx of a wearer's digit, a second shielding element adapted to overlay and protect a middle phalanx of a wearer's digit, and a third shielding element adapted to overlay and protect a proximal phalanx of a wearer's digit.

3. The conformable shielding of claim 1 wherein each of the plurality of shielding elements include opposing sides and an upper portion, wherein the connecting element spans the gap on the opposing sides of the adjacent shielding elements, and terminates short of the upper portion.

4. The conformable shielding of claim 1 wherein the plurality of apertures include at least one connecting element aperture pair, the connecting element aperture pair including a first aperture defined by a first shielding element and a second aperture defined by a second shielding element adjacent the first shielding element.

5. The conformable shielding of claim 4 wherein the first aperture and the second aperture are offset a distance from one another so that the first and second apertures do not overlay one another, the first and second apertures being non-aligned.

6. The conformable shielding of claim 5 wherein the connecting element includes a first end and a second end, wherein the first end includes a portion that extends at least partially into the first aperture, wherein the second end includes another portion that extends at least partially into the second aperture.

7. The conformable shielding of claim 6 wherein the accordion structure is positioned at least partially between the first aperture and the second aperture.

8. The conformable shielding of claim 1 wherein the connecting element includes the plurality of axes about which the adjacent shielding elements can pivot in relation to one another.

9. A conformable shielding for protective equipment, comprising:

a first shielding element constructed from a rigid, impact resistant material, the first shielding element configured to follow the contours of a portion of a wearer's body;

a second shielding element adjacent and joined with the first shielding element, the second shielding element configured to follow the contours of a portion of a wearer's body, the first shielding element and the second shielding element defining a ventilation gap therebetween;

a flexible material overlaying the first shielding element and the second shielding element, the flexible material including a connecting element extending between the first and second shielding elements to join the shielding elements, the connecting element including an accordion structure extending between spaced apart side portions of the first and second shielding elements, wherein the connecting element enables the first and second shielding elements to flex about a plurality of axes, relative to one another, and to extend outwardly from one another, and to retract toward one another, wherein the connecting element is aligned with a joint of the appendage of the wearer, wherein at least a portion of the joint of the wearer's appendage is located under the ventilation gap, the connecting element leaving at least a portion of the ventilation gap uncovered when the appendage is in a flexed state and in an unflexed state, wherein one of the shielding elements includes a projection that protrudes outward over the ventilation gap so that the ventilation gap remains at least partially covered by the projection when the appendage of the wearer is in the flexed state.

10. The conformable shielding of claim 9 wherein the elastomeric material is joined with the shielding elements without extending substantially beyond those shielding elements.

11. The conformable shielding of claim 9 wherein the first and second shielding elements include a plurality of apertures, wherein the elastomeric material at least partially projects into the plurality of apertures to provide a mechanical interlock between the shielding elements and the flexible elastomeric material.

12. The conformable shielding of claim 9 wherein the first and second shielding elements define a connecting element aperture pair, the connecting element aperture pair including a first aperture defined by the first shielding element adjacent the gap and a second aperture defined by a second shielding element adjacent the gap.

13. The conformable shielding of claim 12 wherein the connecting element includes first and second ends, wherein the flexible elastomeric material extends at least partially into each of the first and second apertures to mechanically interlock the first and second ends to the first and second shielding elements.

* * * * *